United States Patent [19]

Eaton et al.

[11] Patent Number: 4,468,903

[45] Date of Patent: Sep. 4, 1984

[54] BUILDING PANEL

[75] Inventors: James W. Eaton, Sleepy Hollow; Erland D. Narhi, Streamwood, both of Ill.

[73] Assignee: Masonite Corporation, Chicago, Ill.

[21] Appl. No.: 373,861

[22] Filed: May 3, 1982

[51] Int. Cl.[3] ..... E04D 1/00

[52] U.S. Cl. ..... 52/105; 52/314; 52/527; 52/555; 52/558

[58] Field of Search ..... 52/558, 541, 540, 539, 52/555, 559, 314, 527, 105

[56] References Cited

U.S. PATENT DOCUMENTS

| | | | |
|---|---|---|---|
| 3,333,384 | 8/1967 | Brady | 52/557 |
| 3,720,031 | 3/1973 | Wilson et al. | 52/520 |
| 3,796,586 | 3/1974 | Hanlon et al. | 52/313 |
| 3,852,934 | 12/1974 | Kirkhuff | 52/539 |
| 3,868,300 | 2/1975 | Wheeler | 162/124 |
| 3,927,501 | 12/1975 | Allen et al. | 52/559 X |
| 3,943,677 | 3/1976 | Carothers | 52/309 |
| 4,065,899 | 1/1978 | Kirkhuff | 52/309.8 |
| 4,279,106 | 7/1981 | Gleason et al. | 52/100 |
| 4,366,197 | 12/1982 | Hanlon et al. | 52/558 X |

*Primary Examiner*—Carl D. Friedman

*Attorney, Agent, or Firm*—Mason, Kolehmainen, Rathburn & Wyss

[57] ABSTRACT

A building panel of wood composite material includes inner and outer faces outlined by opposite ends and upper and lower edges. The panels are adapted to be placed end-to-end in courses or rows arranged in parallel to extend upwardly from a lower edge or eave to cover a building wall or roof structure. Each panel includes an outer face having a lower portion of substantial surface area adapted for exposure to the weather and an upper portion of relatively smaller surface adapted to underlie one or more panels in a next higher course laid in overlapping relation therewith. A large lower portion of the outer face is formed with a surface embossed to resemble a plurality of individual shingle elements positioned in side-by-side relation. Grooves are formed in the outer face of the panel between adjacent shingle elements and each groove tapers from a minimum depth adjacent the upper portion of the outer face to a maximum or greater depth adjacent the lower edge of the panel.

16 Claims, 11 Drawing Figures

BUILDING PANEL

BACKGROUND OF THE INVENTION

1. Field of the Invention

The present invention relates to man made building panels formed of wood composite material and more particularly, relates to building panels suitable for use on an exterior building wall and roof structure. The panels are provided with an outer or weather surface embossed or formed with a design resembling a plurality of shingles in a roof or wall.

2. Description of the Prior Art

A wide ranging variety of relatively large building wall panels for sidewalls and roofs have been developed utilizing boards or panels formed of pressed wood fibers with an embossed outer or weather surface designed to resemble conventional siding or shingles. U.S. Pat. No. 3,796,586 discloses a deep embossed shingle lap siding formed of compressed wood fibers. U.S. Pat. No. 3,868,300 discloses a composite panel laminate having deep indentations and formed with a tough outer fibrous skin and a core of relatively course fibrous material. U.S. Pat. No. 4,279,106 directed towards a roofing panel having a thin shell of hard plastic forming a cavity within which polyurethane foam is received.

OBJECTS OF THE INVENTION

It is an object of the present invention to provide a new and improved modular building panel for use on a sloped roof and/or a vertical wall surface that is leak proof, wind resistant, light in weight, weather resistant, asthetically pleasing to the eye and easy of application.

Another object of the present invention is to provide a new and improved wood composite building panel of the character described which is manufactured with a weather surface shaped or embossed to resemble a plurality of individual shingles or shakes laid side-by-side in a common course.

Yet another object of the present invention is to provide a new and improved building panel of the character described wherein a minimum amount of overlap or head lap is required resulting in a reduced number of individual panels needed for covering a given area of wall or roofing surface.

Yet another object of the present invention is to provide a new and improved building panel of the character described which is essentially self-aligning, easy and quick to install, and which requires a minimum of labor for application on a roof or wall structure.

Yet another object of the present invention is to provide a new and improved building panel of the character described having specially designed grooves positioned between adjacent shingle elements or shakes embossed in the outer surface, which grooves accentuate the appearance of the outer weather surface without substantially weakening the overall structure of the panels at the groove lines.

Another object of the present invention is to provide a new and improved building panel of the character described which is substantially uniform in thickness except for minor variations resulting from the embossing or shaping process and at the grooves which taper from a minimum depth adjacent an upper level of the exposed or weather surface of the panel to a greater or maximum depth adjacent the lower edge of the panel.

Yet another object of the present invention is to provide a new and improved building panel of the character described in the foregoing objects which minimizes the visibility of joints between panels and which minimizes any flow of wind driven water tending to be channeled upwardly in the grooves or tending to penetrate under the head lap between adjacent courses of panels.

Still another object of the present invention is to provide a new and improved building panel of the character described wherein the grooves are designed break out or merge with the adjacent outer surface of the panel before reaching the upper of head of the building panel.

Yet another object of the present invention is to provide a new and improved building panel of the character described which is essentially formed of one type of material yet provides increased strength, lightness in weight per unit area covered and does not suffer from curl-up or cupping along lower edge portions or corners of individual embossed shingle elements.

BRIEF SUMMARY OF THE INVENTION

The foregoing and other objects and advantages of the present invention are accomplished in a new and improved building panel formed of wood composite material in a body of substantially uniform thickness and having inner and outer faces outlined by opposite ends and upper and lower edges. Opposite ends of each panel are adapted to closely face the end of an adjacent panel in the same course and the outer faces of the panels are embossed over a lower portion of substantial surface area adapted for exposure to the weather. A relatively flat upper head lap portion of relatively small surface area is provided and is adapted to underlie lower portions of the back face of one or more panels in a next higher row or course laid in overlapping relation therewith. The lower embossed surface portion of the outer weather face is shaped, preferably by embossing to resemble a plurality of individual elements such shingles or shakes positioned or laid in side-by-side relation in a common course. Tapered grooves are formed in the outer face of the panel between adjacent shingle or shake elements and these grooves are especially shaped to taper from a minimum depth adjacent the upper portion of the outer panel face to a greater or maximum depth adjacent the exposed lower or butt edge of the panel. The maximum depth of the grooves is preferably less than the nominal thickness of the panel body and in conjunction with the embossed shingle elements provides an outer or weather surface closely resembling a plurality of cedar shakes or shingles laid up in a course or row.

BRIEF DESCRIPTION OF THE DRAWINGS

For a better understanding of the present invention reference should be had to the following detailed description taken in conjunction with the drawings, in which.

DESCRIPTION OF THE PREFERRED EMBODIMENTS

Figures 1, 2:
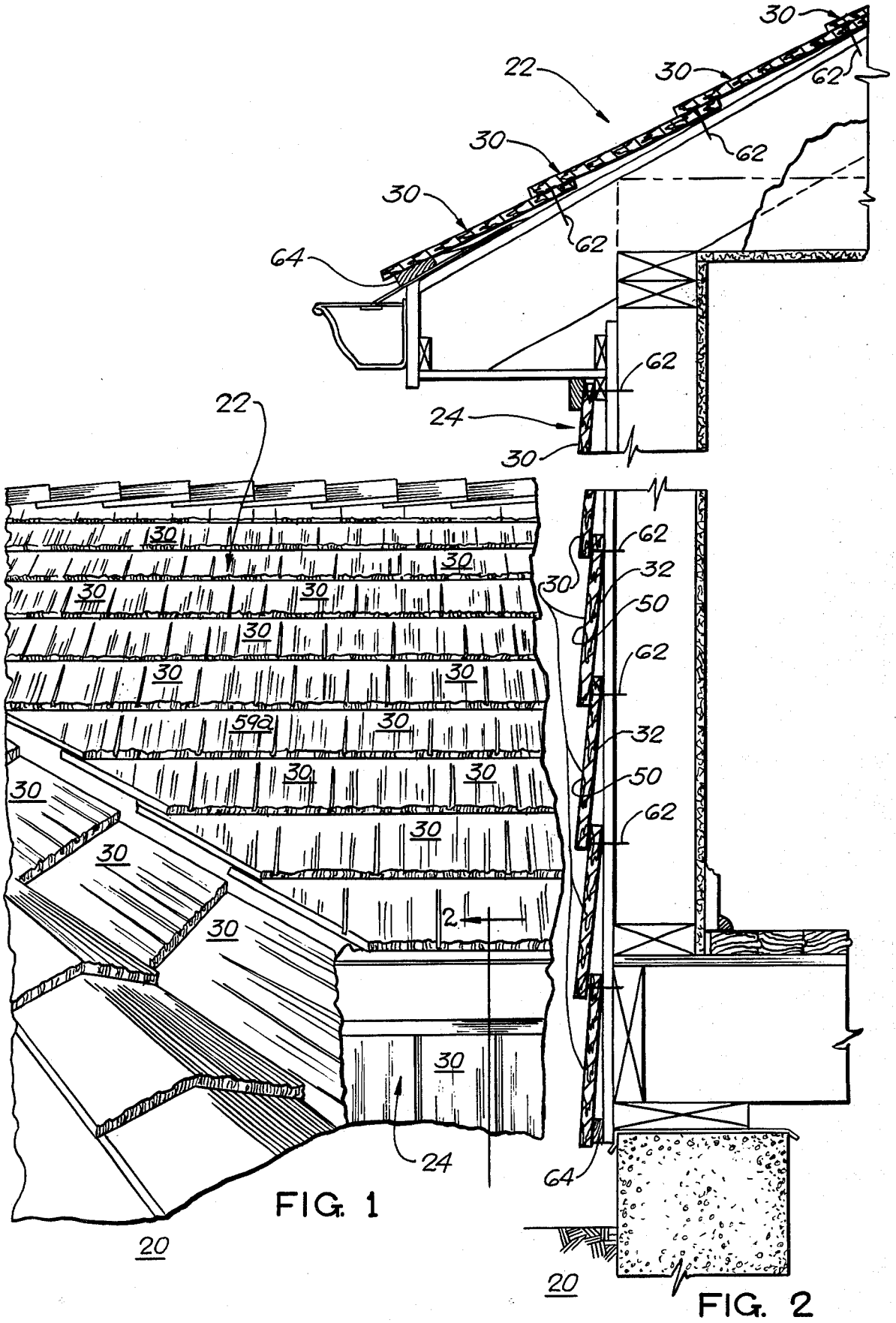
FIG. 1 is a fragmentary elevational view of a building structure utilizing building panels in accordance with the present invention laid up in parallel courses or rows in overlapping relation.
FIG. 2 is a vertical cross-sectional view taken substantially along lines 2—2 of FIG. 1.

Referring now more particularly to the drawings, in FIGS. 1 and 2 is illustrated a building 20 of a general or conventional type employing a sloped roof structure 22 and vertical side walls 24. The roof and walls are covered with an outer or weather surface formed by a plurality of new and improved building panels 30 which are laid up in end-to-end relation in horizontal courses or rows. The panels in each succeeding higher course overlap an upper portion of the adjacent lower course or row as best shown in FIG. 2.

Figure 3:
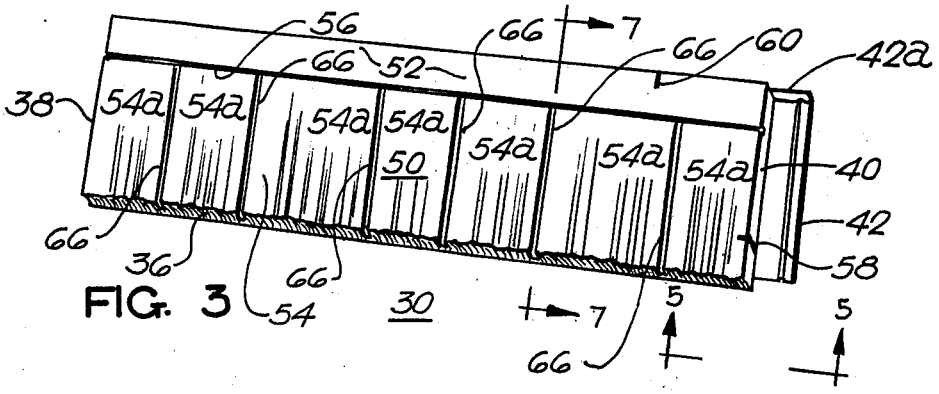
FIG. 3 is a perspective view of one embodiment of a new and improved building panel in accordance with the features of the present invention showing an outer or weather surface thereof and a lower, butt edge.
Figure 4:
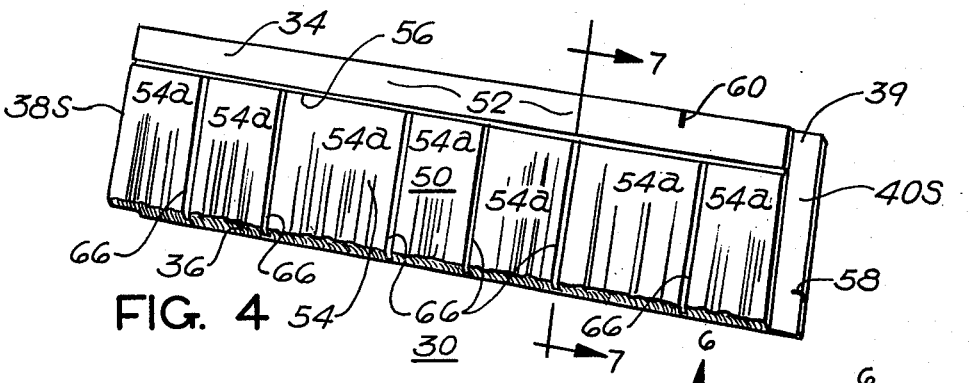
FIG. 4 is a perspective view of another embodiment of a building panel in accordance with the present invention again illustrating an outer or weather surface of the panel and a lower, butt edge.

Each building panel 30 is preferably formed of suitable wood composite material such as flakeboard, chipboard, hardboard, plywood, etc. into a body of a substantially uniform thickness and is of a rectangular shape as shown in FIGS. 3 and 4. The panels include a relatively flat or planar back surface 32 bounded by an elongated upper edge or head 34 and a generally parallel, lower edge or butt edge 36 exposed to the weather. The panel of FIGS. 3 and 5 includes generally flat or planar, opposite, left and right hand end surfaces 38 and 40 perpendicular to the upper and lower edges. These ends are adapted to closely face the adjacent ends of panels laid end-to-end in the same or common course or row as best shown in FIG. 5.

Joints formed between adjacent end surfaces 38 and 40 of panels in a common course or row, are flashed with sheet metal flashing elements 42 which are formed with upstanding head flanges 42*a* at the upper end. The flanges fit against the upper edge or head 34 of the building panels and aid in securing the flashing elements in place on a roof or wall to underlie and flash the joint between the ends of adjacent panels in a common course or row. A small gap or space 44 is normally provided between adjacent facing ends 38 and 40 of each pair of panels in a row in order to accommodate expansion of the panels. The metal flashing elements tend to channel any water in these joint gaps or spaces down onto the outer surface of the panels in the next lower row or course.

Figure 5:
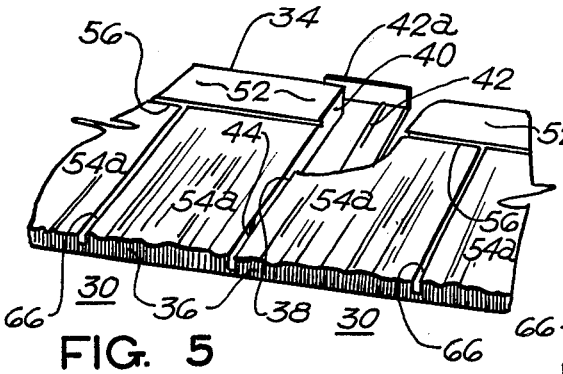
FIG. 5 is a fragmentary, elevational view in perspective illustrating a joint between a pair of building panels of the type shown in FIG. 3 laid up in end-to-end relation in a course or row.
Figure 6:
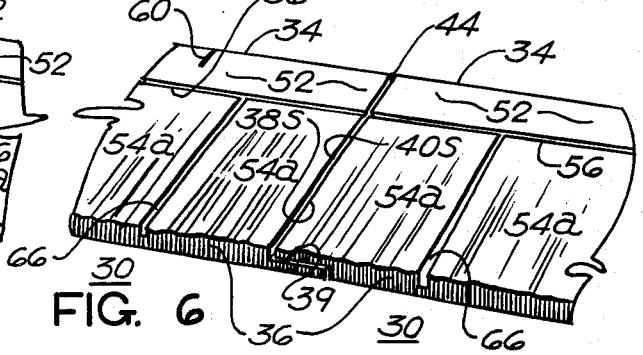
FIG. 6 is a perspective view similar to FIG. 5 illustrating a joint between a pair of building panels of the type shown in FIG. 4, laid up in end-to-end relation in a course or row.
Figure 7:
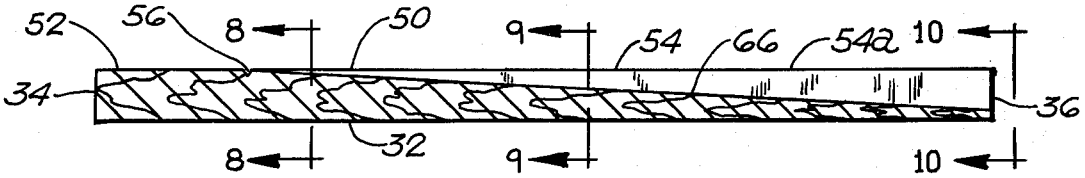
FIG. 7 is a transverse, cross-sectional view of the building panels of FIGS. 3 and 4, taken substantially along lines 7—7 thereof.
Figure 8:
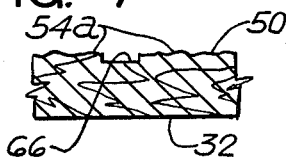
FIG. 8 is a fragmentary, longitudinal, cross-sectional view taken substantially along lines 8—8 of FIG. 7.
Figure 9:
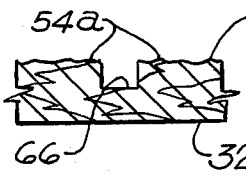
FIG. 9 is a fragmentary, longitudinal, cross-sectional view taken substantially along lines 9—9 of FIG. 7.
Figure 10:
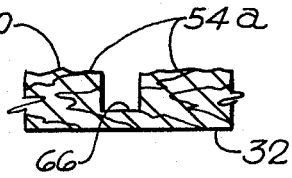
FIG. 10 is a fragmentary, edge elevational view of an upper edge of the building panels of FIGS. 3 and 4 looking in the direction of arrows of FIG. 7.

The building panels 30 of FIGS. 4 and 6 are similar to the panels of FIGS. 3 and 5 except that ship-lap type overlapping end surfaces 38S and 40S are provided at opposite ends of each panel and sheet metal flashing elements are not utilized. When the panels are laid up end-to-end as illustrated in FIG. 6, a small space or gap 44 is provided between the directly facing upper segments of the panel ends 38S and 40S and an upper face of a lower or underlying portion 39 of the ship-lap joint forms a channel bottom for the gap or space between the upper segments of the end surfaces to direct and channel any accumulated water or moisture downwardly toward the next lower course of panels.

In accordance with the present invention, the building panels 30 are formed with an outer or weather face 50 which is generally parallel to the back face 32 except for the minor variations in the thickness because of the shaping or embossing process and at the grooves as will be described hereinafter. The outer surface of each panel 30 is divided to provide a relatively flat and smooth narrow strip or head lap segment 52 along the upper edge and the area of this strip comprises only a fractional or minor portion of the total or overall surface area of the whole building panel. This narrow head lap segment along the upper edge 34 is adapted to underlie a narrow strip of back face 32 along a lower portion of each succeeding panel or panels as they are laid up in place in a next adjacent upper row or course (as shown in FIG. 2). When laid up in place as shown, the narrow overlapping or confronting portions of the panels form a substantially water tight head lap between successive courses or rows of panels on a wall or roof.

The outer weather face of each panel includes an embossed lower surface portion 54 lying below the narrow upper margin 52 and delineated therefrom by a thin, fastener marker line or shallow groove 56 parallel of and spaced between the upper edge 34 and the lower, exposed butt edge 36. The shallow groove or line 56 provides guidance for aid in aligning subsequent rows or courses of panels on a building wall or roof surface. The panels 30 are provided with a course alignment end mark or short line 58, normally located on the righthand end surface 40 or 40S. These course alignment marks are aligned with the upper edges of panels in the next lower course or row as a roofing or siding job proceeds.

In accordance with the present invention the weather or exposed outer face 54 of the outer surface 50 is shaped or deep embossed to resemble closely in appearance, a plurality of individual shingles or shakes 54*a* of random width and order, laid up in side by side relation in a row or course as illustrated. Each shingle element 54*a* terminates along a lower butt edge coincident with the longitudinal edge 36 of the whole building panel 30. Between each pair of adjacent individual shingle elements 54*a* embossed in the surface 54, there is provided a tapered groove or channel 66 which is shown in enlarged detail in FIGS. 7–10. These grooves or channels are dimensioned to taper from a shallow or minimum depth at the upper end adjacent the nailing guide groove or line 56 to a greater or maximum groove depth adjacent the lower or butt edge 36 of the building panel. Each groove breaks out or becomes substantially even with the outer surface of the adjacent pair of embossed shingle elements 54*a* on each side just before reaching the level of the nailing guide line 56. Preferably, the grooves reach a maximum depth at or adjacent the lower butt edge of the panel and this maximum depth may be equal to or less than the nominal thickness of the panel edge.

The tapered grooves with the deep relief provided at the lower or butt edge 36 of the panels results in an overall appearance remarkably indistinguishable from that of a shingles or shakes on a or roof surface. Along the relatively thick, butt edge 36 of each panel, the grooves 66 between each pair of adjacent embossed shingle elements 54*a* are deep and provide the appearance of a space between separate shingles or shakes.

The tapered, deepening grooves form a thick shadow appearance which truly and accurately visually resembles a building surfaced with shingles or cedar shakes. Because the grooves 66 taper to a minimum depth and break out at the upper end thereof adjacent the nail guide line 56 before reaching the head lap strip area 52, there is little chance that wind driven water will be forced under the head lap between adjacent courses of panels. Instead, any water will tend to spill out from the sides of the grooves at the shallow upper end and then run back down the outer faces 54*a* of the adjacent shingle elements on either side of the groove.

The unique grooves 66 also provide another enhancing feature in that the building panel 30 is dimensioned to retain full nominal thickness uninterrupted for the entire length thereof above the nailing guide grooves 56 and in this area 52, fastening attachment to a building wall or roof is accomplished at the strongest portion of each panel. The panels 30 are thus strong where needed and are not subject to peel-up or fish mouthing which is a problem with many shingles and roofing materials. The tapered grooves 66 provide a panel 30 which closely resembles a plurality of shingles or, cedar shakes yet without requiring the great amount of labor that is normally required in the application of such. Moreover, the uniquely shaped grooves greatly enhance the appearance of the panels 30 and do not detract from the strength thereof where needed because at the fastening area on the head lap strip 52, the panel body is maintained at full nominal thickness. The tapered grooves provide deep shadows and relief to form an appearance closely simulating a plurality of shingles or shakes without the high cost of application thereof.

Figure 11:
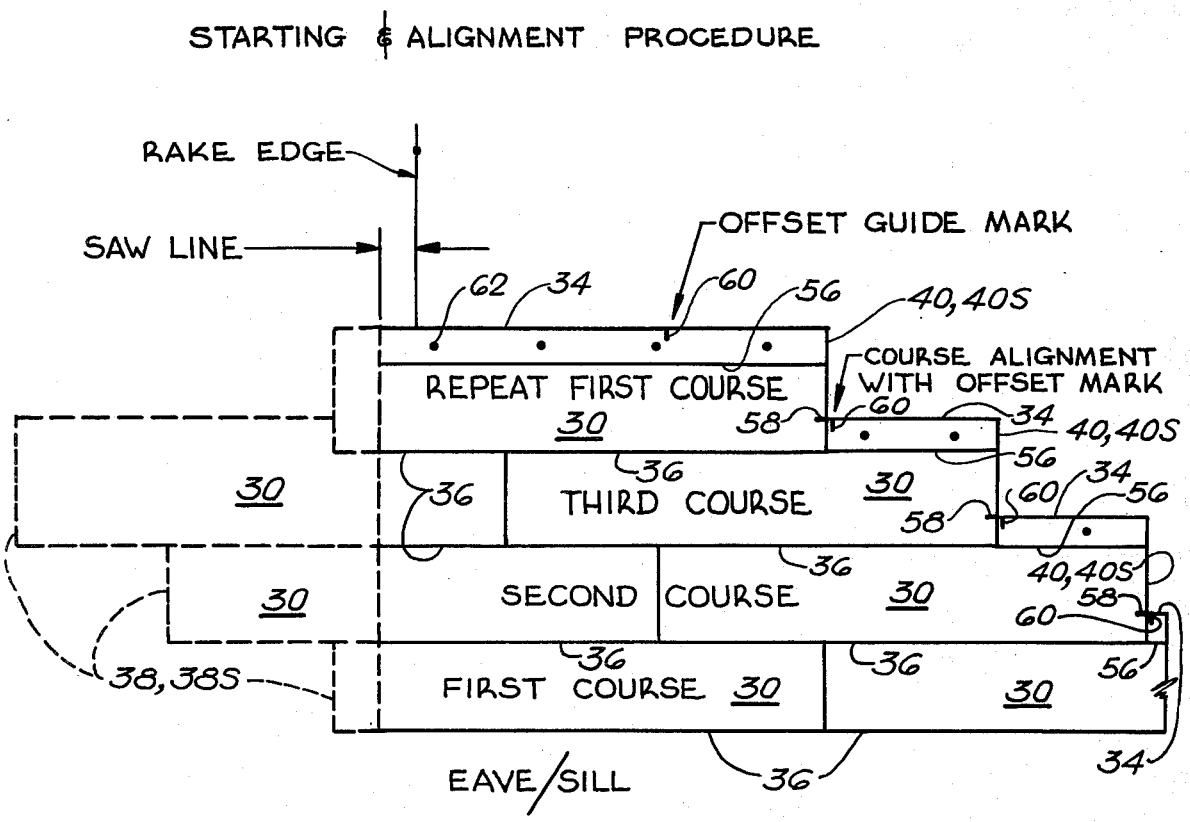
FIG. 11 is a graphic representation of a starting and alignment procedure utilized when installing building panels in accordance with the present invention on a roof or building wall structure.

As illustrated in FIG. 11, the course alignment marks 58 of panels 30 in the second course are positioned over the upper edges 34 of the panels in the first course and this aids a roofer in establishing precise parallel alignment of the lower or butt edges 36 of the panels in each succeeding course. The butt edge of panels in the second course are also visually aligned with the shallow grooves or lines 56 in the panels of first course to further insure that each succeeding course is precisely parallel to the last. The lines 56 and end marks 58 thus function cooperatively to aid an installer in easily establishing the precise and proper amount of headlap or overlap between the panels as they are installed in each succeeding course or row.

Each panel 30 also includes a course offset guide mark 60 formed on the outer weather face 50 and positioned in the upper head lap or strip 52 adjacent the upper edge 34. The guide marks 60 are preferably located at a distance approximately ⅓ of the total length of a panel along the edge 34 inwardly from the right hand end 40 or 40S. As illustrated in FIG. 11, the course offset guide mark on the upper edges of the panels 30 laid in the first course are used for aligning the right hand edges 40 or 40S of the panels in the second course. Similarly offset guide marks in the panels of the second course are used for aligning the right hand edges 40 and 40S of the panels in the third course.

When the offset guide marks 60 are spaced approximately ⅓ of the total length of the panels inwardly from the one end thereof, the course orientation of the panels repeats itself every third course or row that is applied on a wall or roof structure. The positioning of the offset guide marks on a panel can be changed to a different end spacing, for example, a random spacing basis, if desired, but at somewhat increased production expense. If this is done there will be little chance of any periodic repetition of succeeding courses and a truly random pattern will result. However, it has been established that a repeat of course orientation every third course or row is almost imperceptible to the eye and provides a truly aesthetic as well as an economical weather covering for a building.

As illustrated in FIG. 11, a roof or building wall structure is surfaced with the building panels 30 by applying a first course along a lower edge or eave with a left hand end 38/38S extended outwardly beyond a "saw line" which in turn is spaced outwardly of a rake edge of the building. Successive panels in the first course are then laid end to end along the row. A second course is started with the left hand end 38/38S of a first panel in the course extended outwardly to the left even beyond the left hand end of the end panel in the first course. Similarly, the left end panel in the third course extends outwardly to the left farther than the starter panel of the second course. Eventually these outwardly projecting panel end portions are cut off along the "saw line". The cut off portions may sometimes be utilized at the opposite (right hand) end of the course or on other parts of the structure depending upon the lengths thereof and distance coverage required. The application process as described may also be initiated from a right hand corner along the lower edge or eave and the panels may be aligned end to end in each course or row from right to left proceeding to the lefthand rake edge of the building or roof structure.

In applying the panels 30 to a roof or wall surface it is recommended that the panels be installed over a minimum base of ½ inch thick CDX plywood or equivalent sheathing or decking. The sheathing or decking should also be covered with a layer of 15 pound asphalt felt or similar material prior to installation of the panels thereon. Nails or staples 62 are used to secure the panels in place and these fasteners are driven above the nailing line or groove 56 in the narrow, head lap or strip area 52, so as not to be exposed to the weather. Generally, galvanized roofing nails or staples are recommended, and normally five or six spaced apart fasteners are used to hold a 48" long building panel in place.

In practice, panels having a nominal length of 48 inches are preferred and panels of this size can be handled and applied by one man. Along the lower edge of a building wall or the eave of roof structure, a narrow starter strip 64 is utilized for the first course and preferably a lower edge of the starter strip is spaced a slight distance upwardly above the lower or thick butt edge 36 of the panels 30 of the starter course as illustrated in FIG. 2.

In a typical commercial embodiment of the present invention, panels 30 are dimensioned to be approximately 47 and 3/16th inches in length and 11 and 13/16th inches in width with a 3 inch wide head lap being provided between the upper edge 34 and the nail guide grooved line 56. The panels are nominally 7/16th inches thick and are packaged with 6 panels per bundle. In this size, only 6 bundles are required to cover 100 square feet or one "square" of a building roof or wall structure. Panels 30 having these size parameters produce a weight of approximately 240 pounds per "square" of surface area covered. This weight is comparable to that of many asphalt shingles but the panels 30 provide a great advantage in terms of the small number of pieces (36) necessary for covering a "square" of surface area. The panels 30 are recommended for use on roof slopes of 4 in 12 or steeper and are economical for use in new construction as well as for re-siding or re-roofing application over old materials already in place.

Although the present invention has been described with reference to several illustrated embodiments thereof, it should be understood that numerous other modifications and embodiments can be made by those skilled in the art that will fall within the spirit and scope of the principles of this invention.

What is claimed as new and is desired to be secured by Letters Patent is:

1. A unitary building panel formed of a single piece of fibrous wood material pressed to a substantially uniform thickness overall and having generally parallel opposite inner and outer faces outlined by opposite ends and by upper and lower edges, said opposite ends of said panel adapted to closely face the end of an adjacent panel in the same course, said outer face having a lower portion of substantially larger surface area than an upper portion of a relatively smaller surface which is generally flat and adapted to underlie a lower portion of one or more panels in a next higher course laid in overlapping relation to form a narrow heap lap therewith, said larger lower portion of said outer face adapted for exposure to weather, substantially coplanar with said smaller flat upper portion and having an irregular surface deeply embossed to resemble a plurality of individual shingle-like elements positioned in side by side relation in a common course, and at least one groove formed in said outer face of said panel positioned between adjacent pairs of individual shingle-like elements and extending from said smaller upper portion of said outer face to a lower end open at said lower edge of said panel, said groove tapering from a minimum depth adjacent said smaller upper portion of said outer face to a greater depth adjacent said lower edge of said panel whereby said single panel resembles a plurality of tapered thick butt shingles laid in a common course with the lower edges of said elements along a common edge plane.

2. The building panel of claim 1 wherein said inner face along a lower edge portion is generally flat in order to form a tight head lap between panels when panels are laid up in overlapping relation in successive courses.

3. The building panel of claim 1 formed substantially entirely of wood fibers pressed to a substantially uniform overall thickness except for variations in said embossed outer face and at said grooves.

4. The building panel of claim 1 wherein said opposite ends are generally flat between said inner and outer faces and said upper and lower edges.

5. The building panel of claim 1 wherein said opposite ends are formed to provide a ship-lap joint between adjacent ends of panels laid end to end in the same course.

6. The building panel of claim 5 wherein said ship-lap joint is formed by an underlying end portion on one end of a panel having a surface spaced between said inner and outer faces and adapted to overlap said underlying end portion of an adjacent panel laid up end to end therewith in the same course.

7. The buildihg panel of claim 1 wherein said lower edge is embossed to resemble the butt edge of a plurality thick butt shingles in a common course.

8. The building panel of claim 1 including means for delineating between said lower larger surface area and said upper smaller surface area of said outer face.

9. The building panel of claim 8 wherein said delineating means includes a marker line parallel between said upper and lower edges extending between said opposite ends.

10. The building panel of claim 9 wherein said marker line comprises a shallow groove in said outer face.

11. The building panel of claim 1 including a course offset guide mark along said upper edge spaced a selected distance from one of said opposite ends on said outer face.

12. The building panel of claim 11 wherein said course offset guide mark is positioned in said upper portion of relatively smaller surface area above said marker line.

13. The building panel of claim 1 including a course alignment mark adjacent one of said opposite ends adapted to overly an upper edge of a panel in a next lower course.

14. The building panel of claim 13 wherein said course alignment mark is spaced is spaced upwardly from said lower edge substantially the same distance as the spacing between said upper edge of said panel and an upper edge of said lower substantially larger surface area of said outer face.

15. The building panel of claim 1 wherein said grooves taper to a maximum depth adjacent said lower edge.

16. The building panel of claim 15 wherein said maximum depth of said grooves in less than the thickness of said panel along said lower edge.

* * * * *